US011577257B2

(12) United States Patent
Müller

(10) Patent No.: US 11,577,257 B2
(45) Date of Patent: Feb. 14, 2023

(54) TEMPERATURE-CONTROLLED CENTRIFUGE WITH PROTECTIVE GAS RELEASE IN CASE OF ROTOR CRASH

(71) Applicant: Eppendorf AG, Hamburg (DE)

(72) Inventor: Heiko Müller, Borsdorf (DE)

(73) Assignee: Eppendorf AG, Hamburg (DE)

( * ) Notice: Subject to any disclaimer, the term of this patent is extended or adjusted under 35 U.S.C. 154(b) by 389 days.

(21) Appl. No.: 16/955,310

(22) PCT Filed: Dec. 3, 2018

(86) PCT No.: PCT/EP2018/083335
§ 371 (c)(1),
(2) Date: Jun. 18, 2020

(87) PCT Pub. No.: WO2019/120967
PCT Pub. Date: Jun. 27, 2019

(65) Prior Publication Data

US 2021/0001352 A1 Jan. 7, 2021

(30) Foreign Application Priority Data

Dec. 20, 2017 (DE) ..... 10 2017 130 785.0

(51) Int. Cl.
*B04B 7/06* (2006.01)
*B04B 15/02* (2006.01)

(52) U.S. Cl.
CPC ..... *B04B 7/06* (2013.01); *B04B 15/02* (2013.01); *B04B 2007/065* (2013.01)

(58) Field of Classification Search
CPC ..... B04B 15/02; B04B 7/02; B04B 7/06; B04B 2007/065
(Continued)

(56) References Cited

U.S. PATENT DOCUMENTS 2,854,189 A 9/1958 Garrett
3,600,900 A 8/1971 Buddecke
(Continued)

FOREIGN PATENT DOCUMENTS

DE 102014110467 A1 1/2016
EP 0094192 A1 11/1983
(Continued)

OTHER PUBLICATIONS

Machine translation for EP-3015791-A1 May 2016.*
Machine translation for JP-2001321699-A Nov. 2001.*

*Primary Examiner* — Charles Cooley
(74) *Attorney, Agent, or Firm* — Smartpat PLC

(57) ABSTRACT

A centrifuge (10) and a method for preventing the ignition of combustible temperature control media in centrifuges (10) after a crash of the centrifuge rotor are presented. Ignition is prevented by the release of a protective gas in the event of a crash. More precisely, the released protective gas forms a flow that displaces the oxygen, distributes the escaping temperature control medium and fundamentally changes the momentary ratio of the concentration of oxygen to temperature control medium in such a manner that no ignition can take place either inside or outside the centrifuge (10). Thereby, combustible temperature control media can be used without safety concerns for controlling the temperature of centrifuges (10).

17 Claims, 4 Drawing Sheets

(58) Field of Classification Search
USPC ..... 494/14
See application file for complete search history.

(56) References Cited

U.S. PATENT DOCUMENTS

| | | | | |
|---|---|---|---|---|
| 4,693,702 | A * | 9/1987 | Carson | B04B 7/06 494/84 |
| 5,137,604 | A * | 8/1992 | Meeks | F26B 25/006 203/2 |
| 5,334,130 | A * | 8/1994 | Glater | B04B 5/0414 202/205 |
| 5,356,365 | A | 10/1994 | Brierton | |
| 5,551,241 | A | 9/1996 | Boeckel et al. | |
| 6,866,621 | B1 * | 3/2005 | Muller | B04B 15/02 494/7 |
| 10,471,441 | B2 * | 11/2019 | Eberle | B04B 7/02 |
| 10,894,260 | B2 * | 1/2021 | Eberle | B04B 7/02 |
| 2005/0043163 | A1 | 2/2005 | Malugvist et al. | |
| 2011/0160030 | A1 * | 6/2011 | Heilmann | B04B 15/02 494/14 |
| 2015/0080202 | A1 * | 3/2015 | Mueller | F25B 49/022 494/7 |
| 2017/0209874 | A1 * | 7/2017 | Hornek | B04B 15/02 |
| 2017/0370605 | A1 | 12/2017 | Makino et al. | |
| 2021/0001352 | A1 * | 1/2021 | Müller | B04B 7/06 |
| 2021/0252526 | A1 * | 8/2021 | Müller | F25B 39/02 |

FOREIGN PATENT DOCUMENTS

| | | | | |
|---|---|---|---|---|
| EP | 2541666 | B1 | 8/2014 | |
| EP | 3015791 | A1 * | 5/2016 | B04B 15/02 |
| GB | 1357010 | A | 6/1974 | |
| GB | 2010706 | A * | 7/1979 | B04B 13/00 |
| JP | S49103260 | A | 9/1974 | |
| JP | 2001321699 | A * | 11/2001 | B04B 13/00 |
| JP | 2001321699 | A | 11/2001 | |
| JP | 2006207928 | A | 8/2006 | |
| JP | 2015513447 | A | 5/2015 | |
| JP | 2015104701 | A | 6/2015 | |
| WO | WO-9316808 | A1 * | 9/1993 | B01J 19/14 |
| WO | 2016153021 | A1 | 9/2016 | |

* cited by examiner

TEMPERATURE-CONTROLLED CENTRIFUGE WITH PROTECTIVE GAS RELEASE IN CASE OF ROTOR CRASH

TECHNICAL FIELD

The present disclosure relates to a temperature-controlled centrifuge and a method for preventing the ignition of combustible temperature control media.

BACKGROUND

Centrifuge rotors are used in centrifuges, in particular laboratory centrifuges, to separate the components of samples centrifuged in them by utilizing mass inertia. In doing so, increasingly higher rotation speeds are used to achieve high segregation rates. Laboratory centrifuges are centrifuges whose rotors operate at preferably at least 3,000, preferably at least 10,000, in particular at least 15,000 revolutions per minute and are usually placed on tables. In order to be able to place them on a worktable, they have a form factor of less than 1 m×1 m×1 m; thus, their installation space is limited. In doing so, the depth of the device is preferably limited to max. 70 cm.

Such centrifuges are used in the fields of medicine, pharmacy, biology and chemistry, etc.

The samples to be centrifuged are stored in sample containers, and such sample containers are driven in rotation by means of a centrifuge rotor. In doing so, the centrifuge rotors are usually set in rotation by means of a vertical drive shaft driven by an electric motor. There are different centrifuge rotors that are used depending on the application. Thereby, the sample containers can either contain the samples directly, or the sample containers have their own sample receptacles that contain the sample, such that a multiple number of samples can be centrifuged simultaneously in one sample container. Generally, centrifuge rotors in the form of fixed-angle rotors and swing-out rotors are known.

In most cases, it is provided that the samples are centrifuged at defined temperatures. For example, samples containing proteins and similar organic substances must not be overheated, such that the upper limit for the temperature control of such samples is normally in the range of +40° C. On the other hand, certain samples are cooled by default in the range of +4° C. (the anomaly of water starts at 3.98° C.).

In addition to such predetermined maximum temperatures of, for example, approximately +40° C. and standard test temperatures of, for example, +4° C., additional standard test temperatures are also provided for, for example, at +11° C., in order to, at such temperature, check whether the refrigeration system of the centrifuge is running in a controlled manner below room temperature. On the other hand, it is necessary for occupational safety reasons to prevent the touching of elements that have a temperature greater than or equal to +60° C.

In principle, active and passive systems can be used for temperature control. Passive systems are based on air-assisted ventilation. This air is guided directly past the centrifuge rotor, which results in temperature control. In doing so, the air is sucked through openings into the centrifuge vessel and, through further openings, the heated air is discharged again at another point of the centrifuge vessel, whereby the suction and discharge takes place independently by means of the rotation of the centrifuge rotor.

On the other hand, active cooling systems have a refrigerant circuit that regulates the temperature of the centrifuge container, which indirectly cools the centrifuge rotor and the sample containers contained therein. Many different media are used as cooling or temperature control media. Since, in principle, not only cooling (that is, heat reduction), but also heat increases can be desired, specifically during centrifugation, the present invention refers to controlling temperature and temperature control media. In addition to the temperature control media usually used for centrifuges, such as chlorodifluoromethane, tetrafluoroethane, pentafluoroethane or difluoromethane and many others, there are also combustible temperature control media such as butane or propane, or also various synthetic mixtures.

Although such combustible temperature control media have very good heat transfer properties, they are usually not used for safety reasons, as the temperature control means can escape and ignite in the event of a crash of the centrifuge rotor. In the event of such a crash, fragments of the centrifuge rotor can act at high speed and thus with very high energy within the centrifuge, thereby also destroying the evaporator and lines carrying the temperature control medium. The escaping combustible temperature control medium can then be easily ignited by the energy released in the crash and by electrical or electronic components inside the centrifuge or in its vicinity, which can cause very serious damages, in particular personal injuries.

In order to prevent a crash of the centrifuge rotor from causing damage outside the centrifuge, stiffening and reinforcing means inside the centrifuge have already been proposed. However, this would not prevent temperature control media from escaping, because the lines of the temperature control means, which form the evaporator, run around the centrifuge container, with respect to such reinforcing means between the centrifuge rotor and the reinforcing means.

SUMMARY

It is the object of the present invention to propose a centrifuge that can be used with combustible temperature control media, without these representing a safety risk in the event of a crash of the centrifuge rotor.

This object is achieved with the centrifuge as described and claimed and the method for preventing the ignition of combustible temperature control media as described and claimed.

On the part of the inventor, it was recognized that such object can be solved in a surprisingly simple manner by releasing a protective gas in the event of a crash of the centrifuge rotor, such that the oxygen-temperature medium mixture is not ignitable. More precisely, the released protective gas forms a flow that displaces the oxygen, distributes the escaping temperature control medium and fundamentally changes the momentary ratio of the concentration of oxygen to temperature control medium in such a manner that no ignition can take place either inside or outside the centrifuge.

As such, the centrifuge in accordance with the invention, in particular a laboratory centrifuge, has a centrifuge container, in which a centrifuge rotor can be accommodated, a motor for driving the centrifuge rotor, temperature control means for controlling the temperature of the centrifuge rotor and a housing in which the centrifuge container, the centrifuge rotor, the temperature control means and the motor are accommodated, wherein the temperature control means comprise a combustible temperature control medium that is guided in a temperature control medium line, and characterized in that the centrifuge has a protective gas and is adapted to release the protective gas in the event of a crash of the centrifuge rotor.

In an advantageous additional form, it is provided that the protective gas is an inert gas, which preferably comprises at least one gas from the group of argon, helium, carbon dioxide, krypton, neon, nitrogen and xenon. Such gases are particularly effective protective gases.

In an advantageous additional form, it is provided that the protective gas is guided in a protective gas line, which extends around the centrifuge container with at least one, preferably several windings. Then, the protective gas is guided as close as possible to the centrifuge container, such that the centrifuge rotor in the centrifuge container always immediately destroys the protective gas line in event of a crash, and thus automatically releases the protective gas.

In an advantageous additional form, it is provided that the protective gas line is connected to a protective gas source, which preferably contains the protective gas under a pressure above atmospheric pressure. This allows a large quantity of protective gas to be continuously released in the event of a crash of the centrifuge rotor. If there is a pressure above atmospheric pressure, the flow of the protective gas is independent of external energy and not only the oxygen in the air inside the centrifuge is displaced, but there is also an air flow out of the centrifuge that creates a moving atmosphere in the environment and thus a further dilution of the mixture generated, which prevents ignition.

In an advantageous additional form, it is provided that a throttling element, in particular a permanently adjusted throttling element, is arranged between the protective gas line and the protective gas source. This prevents sudden expansion and extends the outflow time of the protective gas, such that the ambient air is displaced for a longer period of time and the escaping temperature control medium is mixed and scattered with the escaping protective gas.

In an advantageous additional form, it is provided that at least two sections, preferably more, in particular each winding of the protective line, is connected in parallel with the source of the protective gas. This allows the protective gas to be released in sufficient quantity, regardless of which part of the protective gas line is opened by the crash.

In an advantageous additional form, it is provided that the protective gas line is arranged at least in some areas with respect to the centrifuge container next to and/or below the temperature control medium line. Then, the protective gas line is always opened first or at least simultaneously with the temperature control medium line. In addition, the protective gas line forms an additional crash absorber, such that it is possible that an opening of the temperature control medium line can be prevented.

In an advantageous additional form, it is provided that the protective gas line and the temperature control medium line are externally connected, preferably soldered, at least in some areas, preferably at least over a quarter, most preferably at least over a third, in particular at least over half of their respective winding lengths. This favors a particularly good transfer of heat. If the soldered connection is preferably less tear-resistant than the temperature control medium line, it is ensured that the protective gas line is opened earlier than the temperature control medium line.

In an advantageous additional form, it is provided that the protective gas line has a smaller wall thickness than the temperature control medium line, at least in some areas. This ensures that the protective gas is released with priority before the temperature control medium.

In an advantageous additional form, it is provided that the protective gas line and/or the temperature control medium line are arranged directly on the centrifuge container, or at least in some areas are at least a component of the wall of the centrifuge container. This also makes the transfer of heat particularly effective and the installation space can be kept smaller, where necessary.

In an advantageous additional form, it is provided that a multi-channel system is formed such that a channel for the protective gas and a channel for the temperature control medium exists. This also makes the transfer of heat particularly effective and the installation space can be kept smaller, where necessary.

In an advantageous additional form, it is provided that monitoring means exist with regard to the condition of the protective gas, preferably the pressure and/or the quantity of protective gas, which are adapted to limit the rotational speed of the centrifuge rotor used in each case to a value that is not critical for a crash of the centrifuge rotor if predetermined values for the condition of the protective gas are not reached; for example, the pressure and quantity fall below predetermined values. This ensures that risky rotor operation is only possible if sufficient protective gas can be provided.

In an advantageous additional form, it is provided that, during the operation of the centrifuge, there is a fan that constantly guides air from the interior of the housing into the environment of the centrifuge. This reduces the concentration of combustible medium inside the centrifuge, thus reducing the risk of ignitable mixtures being formed.

Independent protection is claimed for the method in accordance with the invention for preventing the ignition of combustible temperature control media in centrifuges after a crash of the centrifuge rotor, wherein the centrifuge, which is designed in particular as a laboratory centrifuge, comprises a centrifuge container, in which a centrifuge rotor can be accommodated, a motor for driving the centrifuge rotor, temperature control means for controlling the temperature of the centrifuge rotor and a housing in which the centrifuge container, the centrifuge rotor, the temperature control means and the motor are accommodated, wherein the temperature control means comprises a combustible temperature control medium that is guided in a temperature control medium line, and which is characterized in that protective gas is released in the event of a crash of the centrifuge rotor.

In an advantageous additional form, the centrifuge in accordance with the invention is used.

The features and further advantages of the present invention will be made clear in the following by describing a preferred exemplary embodiment in connection with the figures.

DETAILED DESCRIPTION

Figure 1:
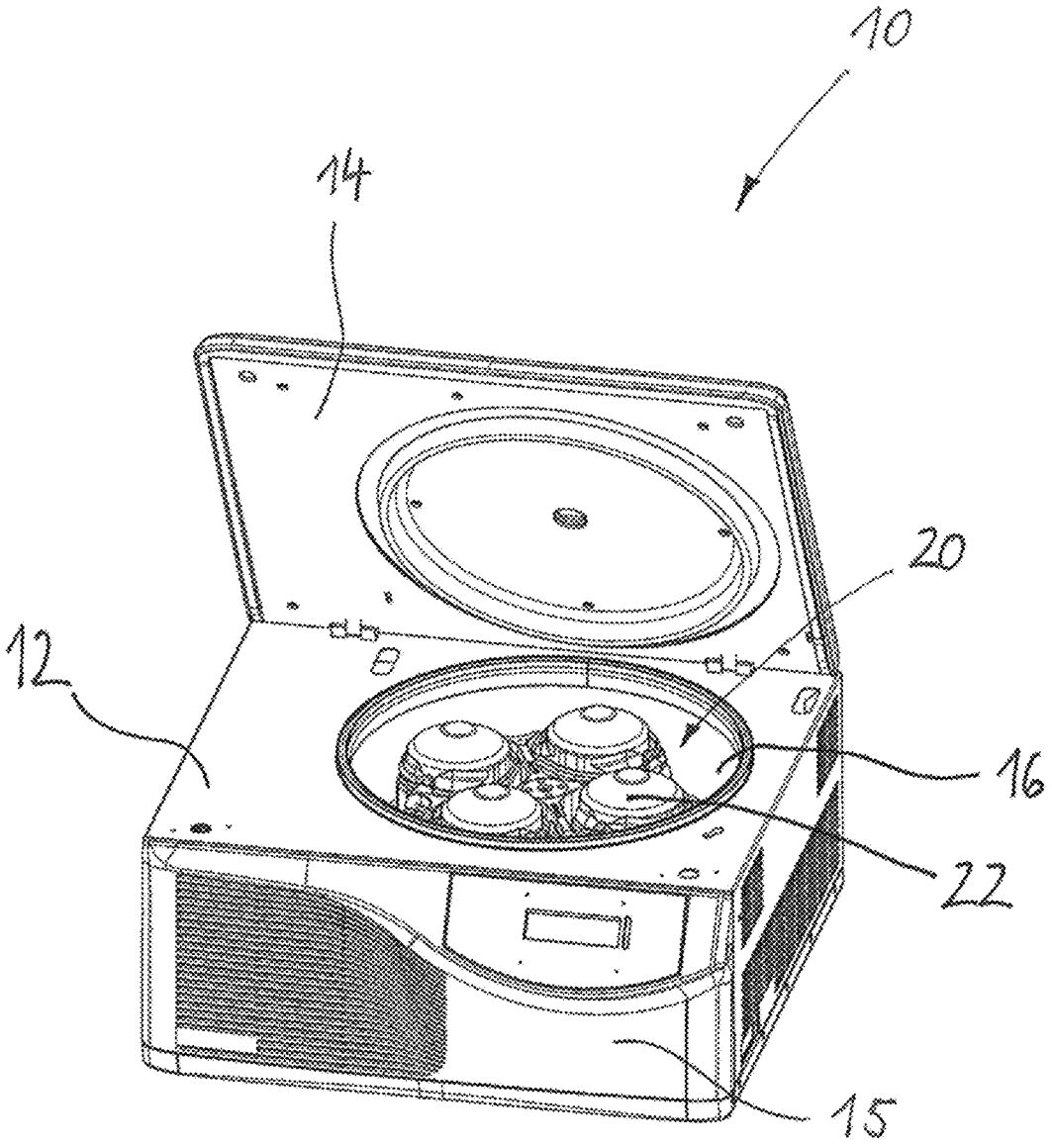
FIG. 1 shows a centrifuge in a perspective view.

In FIGS. 1 to 4, the centrifuge 10 is shown purely schematically in various views.

As shown, centrifuge 10 is designed as a laboratory centrifuge with a housing 12 with a cover 14 and an operating front 15. In the centrifuge container 16 of the centrifuge 10, a centrifuge rotor 20 is arranged on a drive shaft (not shown) of a centrifuge motor 18, which is designed as a swing-out rotor with centrifuge beakers 22.

Figure 2:
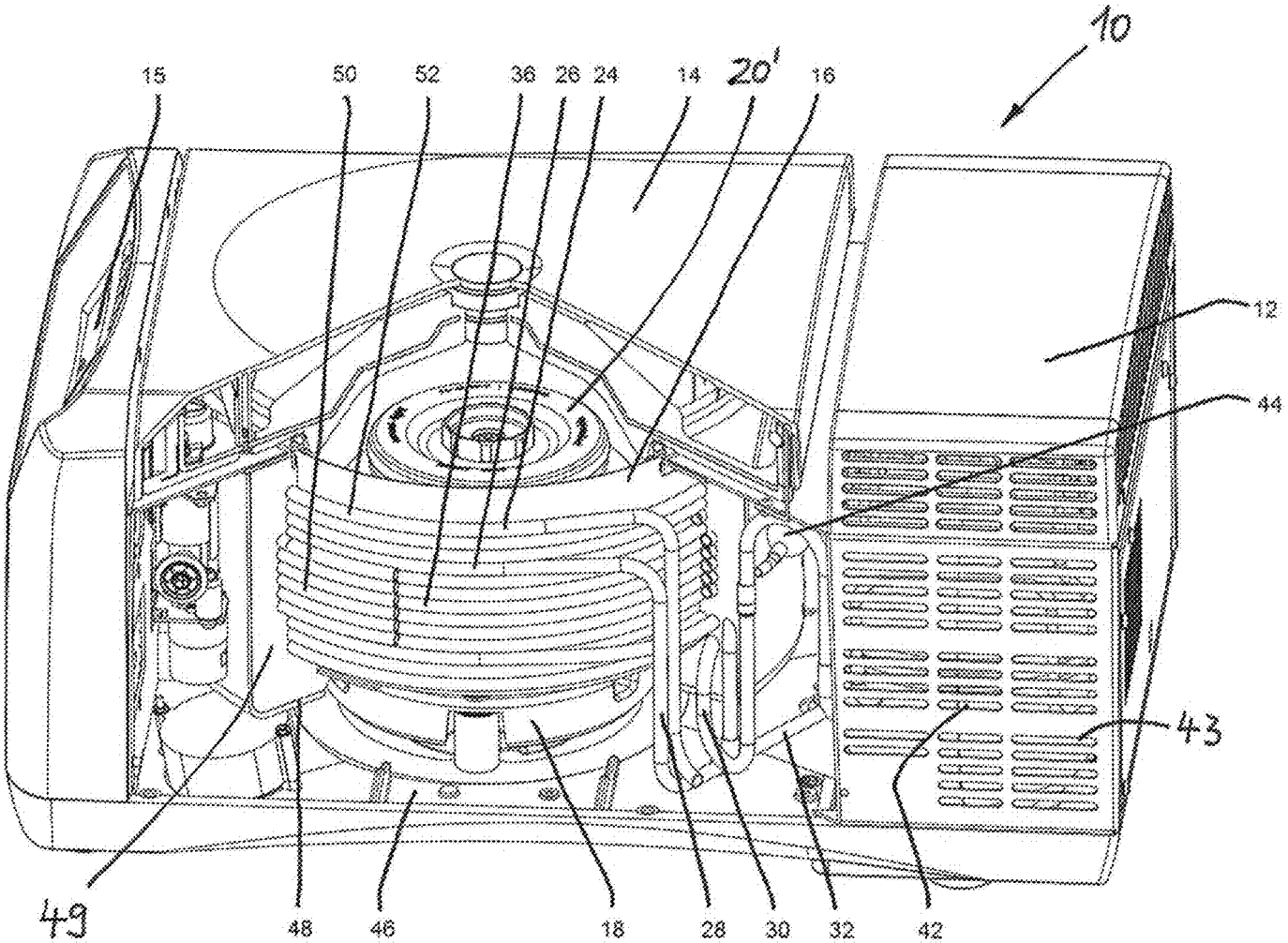
FIG. 2 shows the centrifuge according to FIG. 1 in a first partial sectional view from the right.
Figure 3:
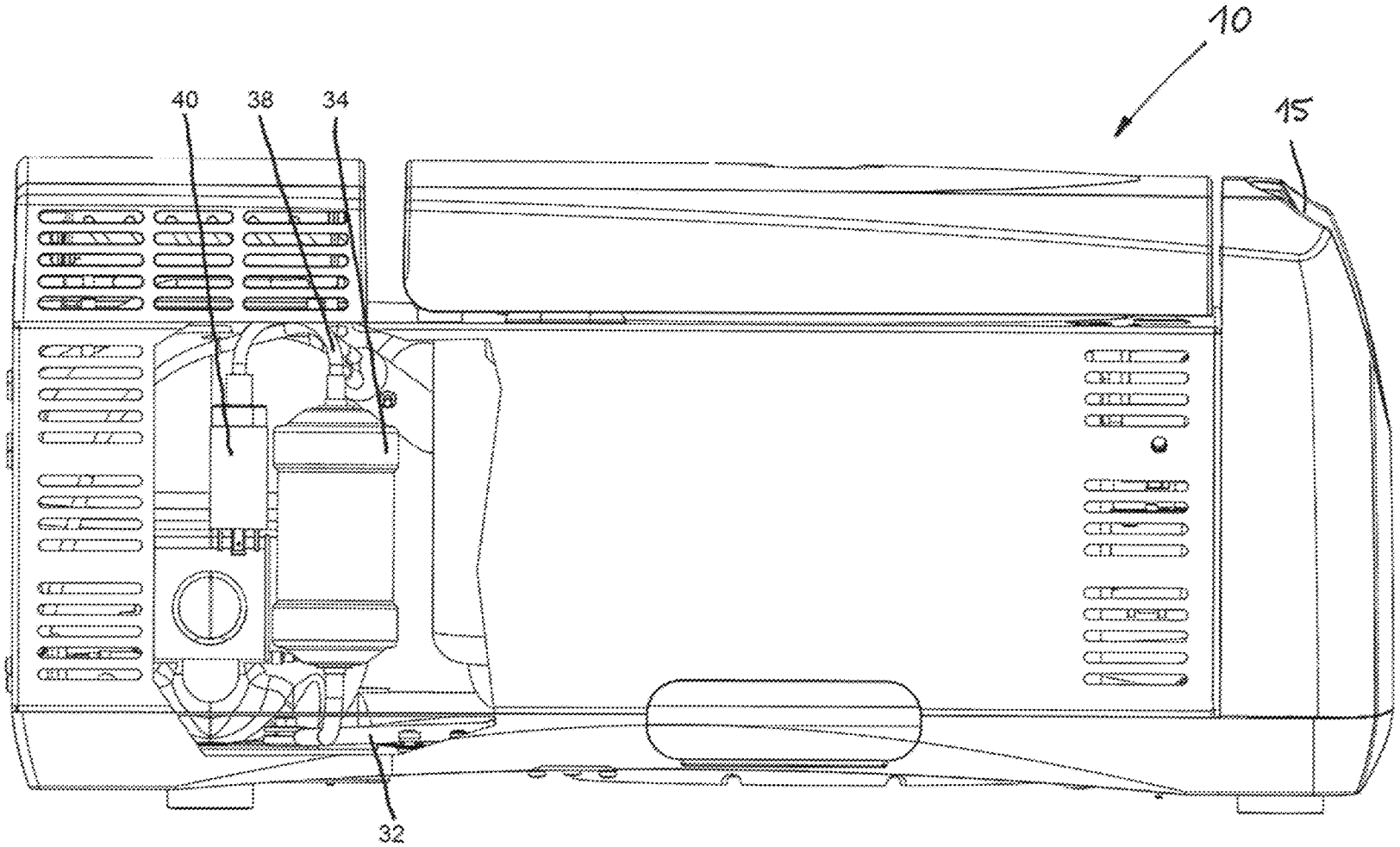
FIG. 3 shows the centrifuge according to FIG. 1 in a second partial sectional view from the left.
Figure 4:
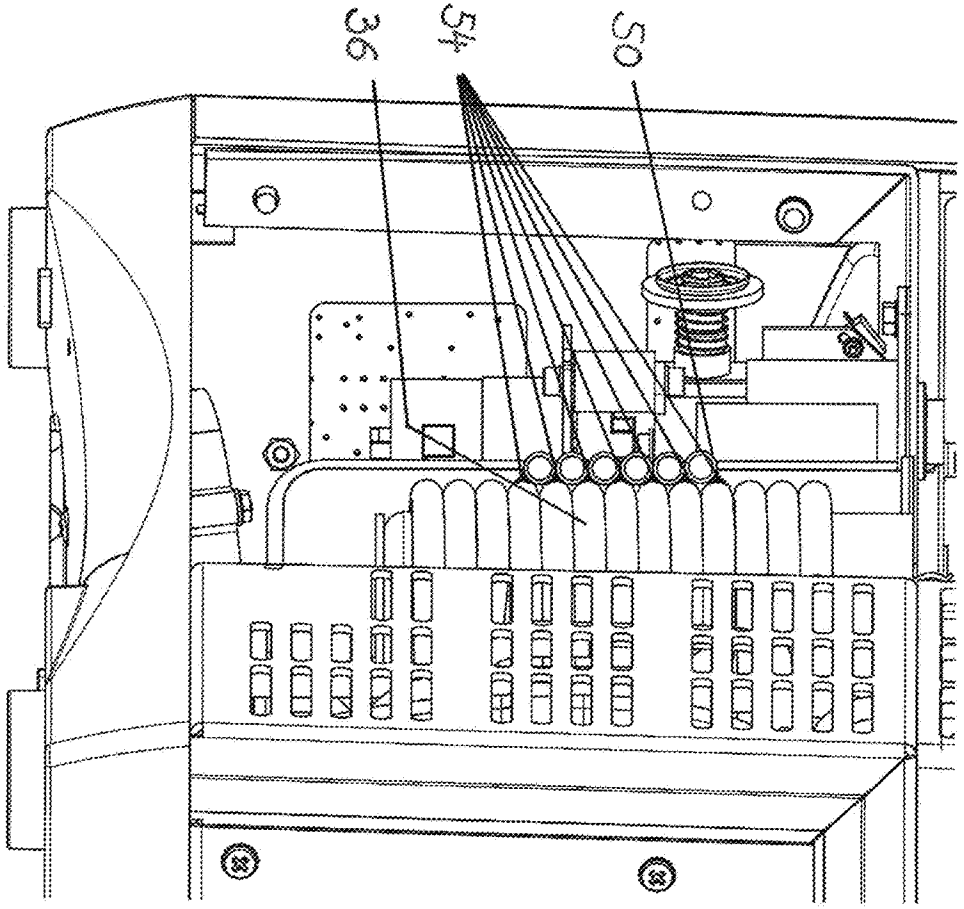
FIG. 4 is a detailed view of FIG. 2.

FIG. 2 shows that the centrifuge container 16 is surrounded by windings of a temperature control medium line 24 and windings of a protective gas line 26. (In FIG. 2, the centrifuge rotor 20' is shown as a fixed angle rotor, in order to show that the present invention is independent of the exact type of the centrifuge rotor 20, 20'.)

The two ends 28, 30 of the protective gas line 26 are brought together and are thus connected in parallel with the supply line 32 of a protective gas container 34, which contains a large quantity (for example, 1000 g) of carbon dioxide as a protective gas under a pressure above atmospheric pressure, for example a liquefied gas.

In order to keep the line length from the protective gas container 34 to all possible points of the protective gas line 26 short, it may alternatively be provided that the individual windings 36 are connected to each other by means of a cross connection (not shown).

A pressure switch 38 is arranged on the protective gas container 34, which pressure switch is connected to the control system (not shown) of the centrifuge 10 via a plug 40.

The temperature control medium line 24 is connected in the usual manner to a compressor 42 (behind the ventilation slots 43 of the housing 12) and to a filter dryer 44.

FIG. 2 also shows that the centrifuge 10 has a protective cover 48 next to a base plate 46, which is provided to prevent, in case of a crash of the centrifuge rotor 20', its parts from being able escape from the centrifuge 10. Such protective cover 48 is therefore dimensioned and designed in terms of material in such a manner that sufficient crash energy can be absorbed. There is thermal insulation 49 between the protective cover 48 and the centrifuge container 16.

The windings of the temperature control medium line 24, especially the winding parts 50, 52, form the evaporator. Thereby, the winding part 50 is located on the winding 36 of the protective gas line 26, and the winding part 52 is located next to the winding 36 of the protective gas line 26.

The jacket surfaces of the windings 36 of the protective gas line 26 are externally connected to the winding parts 50 of the temperature control medium line 24 arranged above them by a soldered connection 54 (see FIG. 4), and the protective gas line 26 and the windings 52 of the temperature control medium line 24 arranged next to the protective gas line 26 are selectively soldered (not shown) to the centrifuge container 16, whereby the temperature control medium line 24 has sufficient heat conduction in all areas of its windings 50, 52 towards the centrifuge container 16, and thus the sufficient active indirect temperature control of the centrifuge rotor 20' and the samples accommodated therein (not shown) is ensured. In doing so, the strength of the soldered connection is such that the connection to the temperature control medium line 24 tears in the area of the winding parts 50 before the temperature control medium line 24 itself tears here.

Tubes in the form of elongated hollow bodies made of any material, preferably copper or aluminum, the length of which is usually much greater than the diameter of their cross-section, are used as the temperature control medium line 24 and the protective gas line 26.

Thereby, it could be provided that the protective gas line 26 and the temperature control medium line 24 have different diameters and/or different wall thicknesses. A smaller wall thickness ensures that the protective gas line 26 is more likely to tear than the temperature control medium line 24. A smaller diameter would allow the protective gas line 26 to be arranged in the free space between the centrifuge container 16 and the windings 50 of the temperature control medium line 24.

Alternatively, the windings 36, 50 of the protective gas line 26 and the temperature control medium line 24 could also run parallel next to each other, for example as a multi-channel solution (not shown), such that the temperature control medium line 24 would be arranged directly on the centrifuge container 16.

In addition, it could also be provided that the temperature control medium line 24 and/or the protective gas line 26 at least partially form the centrifuge container 16 (not shown), which could reduce the required installation space.

During operation, this design of the centrifuge 10 effectively prevents the ignition of the combustible temperature control medium even in the event of a crash of the centrifuge rotor 20, since, in the event of such a crash, components of the centrifuge rotor 20 damage the protective gas line 26 after the centrifuge container 16 has broken through, causing the protective gas to escape.

Since the protective gas is under a pressure above atmospheric pressure, it will flow into the entire interior of the centrifuge 10 and displace the oxygen in the air therein and also dilute the possibly escaping temperature control agent. Due to the generated flow out of the centrifuge 10, the emerging mixture is additionally swirled and further diluted in the ambient air. This prevents the formation of an ignitable mixture.

To monitor this safety function, there is the pressure monitor 38, which continuously monitors the quantity and/or pressure of the protective gas in the protective gas container 34 during the operation of the centrifuge 10. If the pressure monitor 38 detects a condition of the protective gas that is below previously defined values adapted to the specific centrifuge 10, it intervenes in the control system (not shown) of the centrifuge 10 in such a manner that either the centrifuge 10 does not start the centrifuge rotor 20, 20' at all and, if necessary, issues an error message, or that the centrifuge rotor 20, 20' can only be operated up to an uncritical maximum speed at which a crash cannot release any energy that would damage the temperature control medium line 24. This maximum speed is determined beforehand in test series.

A throttle element (not shown) between the protective gas container 34 and the protective gas line 26 is used to adjust the outflow time, such that the ambient air and thus the atmospheric oxygen is displaced for a longer period of time, and the escaping temperature control medium is mixed and scattered with the escaping protective gas.

By providing a fan (not shown) that runs continuously during the operation of the centrifuge 10 in accordance with DIN EN 378, risks of the formation of an ignitable mixture from a leakage in the temperature control medium line 24 are additionally avoided within the housing 12.

It is clear from the above description that the present invention provides a centrifuge 10 with which combustible temperature control media can also be used without safety concerns within the framework of a temperature control process.

Unless otherwise indicated, all features of the present invention may be freely combined. Moreover, the features described in the description of figures can be freely combined with the other features as features of the invention, unless otherwise indicated. Thereby, substantive features of the centrifuge can also be used within the framework of a method reformulated as method features, and method features within the framework of the centrifuge can be reformulated as features of the centrifuge.

LIST OF REFERENCE SIGNS

10 Centrifuge in accordance with the invention, laboratory centrifuge
12 Housing
14 Cover
15 Operating front
16 Centrifuge container
18 Centrifuge motor
20 Centrifuge rotor, swing-out rotor
20' Centrifuge rotor, fixed angle rotor
22 Centrifuge beaker
24 Temperature control medium line
26 Protective gas line
28, 30 Ends of the protective gas line 26
32 Supply line of the protective gas container 34
34 Protective gas container
36 Windings of the protective gas line 26
38 Pressure switch
40 Plug
42 Compressor
44 Filter dryer
46 Base plate
48 Protective cover
49 Thermal insulation
50 Windings of the temperature control medium line 24, which are located above windings 36 of the protective gas line 26
52 Windings 52 of the temperature control medium line 24 arranged next to the protective gas line 26
54 Soldered connection between the windings 36 of the protective gas line 26 and the windings 50 of the temperature control medium line 24

The invention claimed is:

1. A centrifuge (10), comprising:
a centrifuge container (16) in which a centrifuge rotor (20, 20') can be accommodated;
a motor (18) for driving the centrifuge rotor (20, 20');
temperature control means (24, 42, 44) for controlling the temperature of the centrifuge rotor (20, 20'); and
a housing (12) in which the centrifuge container (16), the centrifuge rotor (20, 20'), the temperature control means (24, 42, 44) and the motor (18) are accommodated,
wherein the temperature control means (24, 42, 44) comprise a combustible temperature control medium that is guided in a temperature control medium line (24), and
wherein the centrifuge (10) comprises a protective gas and is adapted to release the protective gas in the event of a crash of the centrifuge rotor (20, 20'), and
wherein the protective gas is guided in a protective gas line (26), which extends around the centrifuge container (16) with one or several windings (36), and
wherein the protective gas line (26) and the temperature control medium line (24) are connected to one another at least in some areas.

2. The centrifuge (10) according to claim 1,
wherein the protective gas is an inert gas.

3. The centrifuge (10) according to claim 1,
wherein the protective gas is at least one gas selected from the group consisting of argon, helium, carbon dioxide, krypton, neon, nitrogen and xenon.

4. The centrifuge (10) according to claim 1,
wherein the protective gas line (26) is connected to a protective gas source (34).

5. The centrifuge (10) according to claim 4,
wherein the protective gas source (34) contains the protective gas under a pressure above atmospheric pressure.

6. The centrifuge (10) according to claim 4,
further comprising a throttle element arranged between the protective gas line (26) and the protective gas source (34).

7. The centrifuge (10) according to claim 4,
wherein at least two sections (28, 30) of the protective line (26) are connected in parallel with the protective gas source (34).

8. The centrifuge (10) according to claim 1,
wherein the protective gas line (26) is arranged at least in areas (36) with respect to the centrifuge container (16) next to and/or below the temperature control medium line (50).

9. The centrifuge (10) according to claim 1,
wherein the protective gas line (26) and the temperature control medium line (24) are soldered to one another at least over a quarter of their respective winding lengths.

10. The centrifuge (10) according to claim 1,
wherein the protective gas line (26) has, at least in some areas, a smaller wall thickness than the temperature control medium line (24).

11. The centrifuge (10) according to claim 1,
wherein the protective gas line (26) and/or the temperature control medium line (24) are arranged directly on the centrifuge container (16) or at least in some areas are at least a component of a wall of the centrifuge container (16).

12. The centrifuge according to claim 1, wherein a multichannel system exists to an effect that there is at least one separate said winding for the protective gas and at least one separate winding for the combustible temperature control medium.

13. The centrifuge (10) according to claim 1, further comprising monitoring means (38) with regard to a condition of the protective gas which are adapted to limit a rotational speed of the centrifuge rotor (20, 20') to a value that is not critical for a crash of the centrifuge rotor (20, 20') if predetermined values far the condition of the protective gas are not reached.

14. The centrifuge (10) according to claim 13,
wherein the monitoring means (38) measure a pressure and/or a quantity of protective gas.

15. The centrifuge (10) according to claim 1,
further comprising a fan that, during operation of the centrifuge (10), continuously guides air from an interior of the housing into an environment of the centrifuge (10).

16. A method for preventing ignition of combustible tempering media in centrifuges (10) after a crash of a centrifuge rotor (20, 20'),
wherein the centrifuge (10) comprises
a centrifuge container (16), in which a centrifuge rotor (20, 20') can be accommodated,
a motor (18) for driving the centrifuge rotor (20, 20'),
temperature control means (24, 42, 44) for controlling the temperature of the centrifuge rotor (20, 20'),
a protective gas line (26) which extends around the centrifuge container (16) with one or several windings (36), and a housing (12) in which the centrifuge container (16), the centrifuge rotor (20, 20'), the temperature control means (24, 42, 44) and the motor (18) are accommodated, and wherein the temperature control means (24, 42, 44) comprises a combustible temperature control medium that is guided in a temperature control medium line (24), the method comprising:

causing fragments of the centrifuge rotor to destroy the protective gas line (26) and thereby release a protective gas guided therein into the centrifuge in the event of a crash of the centrifuge rotor (20, 20') before the fragments can destroy the temperature control medium line (24).

17. A centrifuge (10), comprising:

a centrifuge container (16) in which a centrifuge rotor (20, 20') can be accommodated;

a motor (18) for driving the centrifuge rotor (20, 20');

temperature control means (24, 42, 44) for controlling the temperature of the centrifuge rotor (20, 20'); and a housing (12) in which the centrifuge container (16), the centrifuge rotor (20, 20'), the temperature control means (24, 42, 44) and the motor (18) are accommodated, wherein the temperature control means (24, 42, 44) comprise a combustible temperature control medium that is guided in a temperature control medium line (24), and wherein the centrifuge (10) comprises a protective gas and is adapted to release the protective gas in the event of a crash of the centrifuge rotor (20, 20'), and wherein the protective gas is guided in a protective gas line (26), which extends around the centrifuge container (16) with one or several windings (36), and wherein the protective gas line (26) is arranged such that, in case of a crash, fragments of the rotor break the protective gas line (26), thereby causing the release of the protective gas into the centrifuge, before the fragments can break the temperature control medium line (24).

* * * * *